United States Patent [19]

Poe

[11] Patent Number: 4,788,836

[45] Date of Patent: Dec. 6, 1988

[54] CONSTRAINING TAMPER PROOF PADLOCK HASP APPARATUS

[76] Inventor: Lloyd R. Poe, 7341 S. Marina Pacifica, Long Beach, Calif. 90803

[21] Appl. No.: 155,967

[22] Filed: Feb. 16, 1988

Related U.S. Application Data

[63] Continuation-in-part of Ser. No. 67,538, Jun. 29, 1987, Pat. No. 4,745,783.

[51] Int. Cl.[4] ..... E05B 67/38

[52] U.S. Cl. ..... 70/2; 70/54; 292/281

[58] Field of Search ..... 70/2, 3, 4, 5, 6, 7, 70/8, 9, 10, 11, 12, 54, 55, 56; 292/281, 282, 283, 284, 285, 286

[56] References Cited

U.S. PATENT DOCUMENTS

| | | |
|---|---|---|
| 1,554,592 | 9/1925 | Olson . |
| 3,392,555 | 7/1968 | Beaver . |
| 3,606,423 | 9/1971 | McCarthy . |
| 3,652,114 | 3/1972 | Cady et al. . |
| 3,727,438 | 4/1973 | Knaack . |
| 3,736,016 | 5/1973 | Garvey et al. . |
| 3,744,280 | 7/1973 | Brown et al. . |
| 3,800,570 | 4/1974 | Kaplan . |
| 3,884,057 | 5/1975 | Maurer . |
| 4,106,315 | 8/1978 | Dohanyos . |
| 4,141,232 | 2/1979 | Kelley . |
| 4,157,653 | 6/1979 | Dohanyos . |
| 4,581,907 | 4/1986 | Eberly . |
| 4,745,783 | 5/1988 | Poe ..... 70/2 |

*Primary Examiner*—Robert L. Wolfe

*Attorney, Agent, or Firm*—Fulwider, Patton, Rieber, Lee & Utecht

[57] ABSTRACT

A tamper proof hasp apparatus for use with a conventional padlock incorporating a U-shaped attached shackle pivotable, when unlocked, about a shackle pivot leg. The apparatus includes first and second hasps incorporating respective first and second hasp plates, each formed on one end with a slot for receipt laterally thereinto of the pivot leg of the shackle and formed on the opposite end with bores for receiving the closure leg of such shackle. A spacer tongue projects from such one end of one of the hasp plates to engage one end of such body and maintain such one end spaced from the plates a distance sufficient to limit travel of such shackle relative to such hasp plates. The respective hasps are formed with guard plates projecting laterally of the hasp plates to restrict access to such shackle by tampering tools such as bolt cutters, hacksaws and the like.

13 Claims, 1 Drawing Sheet

CONSTRAINING TAMPER PROOF PADLOCK HASP APPARATUS

CROSS REFERENCE TO RELATED APPLICATIONS

This application is a continuation-in-part of patent application Ser. No. 07/067,538 filed June 29, 1987, now U.S. Pat. No. 4,745,783.

BACKGROUND OF THE INVENTION

1. Field of the Invention

The present invention relates to hasps which receive padlocks to lock the hasp parts together.

2. Description of the Prior Art

Padlocks are typically utilized to lock separable parts, such as doors, gates, covers and lids in their closed positions to secure the contents from unauthorized personnel. A major threat to such security are modern day bolt cutters which provide a high degree of mechanical advantage enabling intruders to quickly and quietly cut through the shackles of conventional padlocks. Efforts to defeat or hinder the effectiveness of such bolt cutters have led to the development of costly oversized padlocks incorporating shackles of increasing size, hardness and toughness. This problem was addressed generally in my co-pending application, Ser. No. 07/067,538, which disclosed a tamper proof hasp apparatus which adequately receives and protects the padlock shackle but fails to take advantage of the retention characteristics of such shackle to constrain the hasp parts against being pried apart. Thus, there exists a need for a padlock hasp apparatus which will guard the padlock shackle from access by conventional tamper tools, constrain the parts against forceful separation from one another and allow the use of conventional, inexpensive and readily available padlocks.

It is also a shortcoming of prior art hasps that the hasps themselves often form the weaker and more vulnerable link in the security system. Some such hasps incorporate a relatively long pivotal strap formed with a slot for receipt over a staple retainer, which strap itself may be easily pried loose. The hasp staples provided for use with oversized padlocks are generally softer and weaker than the shackle of the padlock, thus totally defeating the effectiveness of the padlock.

Efforts to solve these long standing problems has led to the development of different styles of hasps intended to be used with either conventional padlocks having pivoting attached shackles, or specially designed padlocks to minimize the risk of unauthorized entry. One such hasp incorporates an U-shaped hasp member mounted on a box for mating with a second hasp member mounted on a lid. The first and second hasp members, when closed, are intended to cooperate in forming a shroud around the padlock and its shackle to restrict direct access to such shackle. A device of this type is shown in U.S. Pat. No. 3,727,438 to Knaack. Such hasps, while being satisfactory for their intended use on a specific part, suffer the shortcoming that they cannot be applied to a variety of parts where the geometry of the opening varies drastically, such as hinging versus sliding closures. Other shortcomings are that the hasp parts are bulky, require padlock installation before closure of the parts on one another, inhibit padlock operation, and do not incorporate a mounting arrangement which would prevent fastening screws or bolts from being removed by an intruder.

Other efforts have led to the development of hasps for use with padlocks having walls projecting upwardly from the body thereof on opposite sides of the shackle to define protective ears. The hasp then incorporates a hood which is intended to cooperate with the shrouds to block access to the shackle. A device of this type is shown in U.S. Pat. No. 3,652,114 to Cady. While satisfactory for the intended use, such hasps suffer the shortcoming that they require use with padlocks of special design and result in an expensive combination which has limited application and is cumbersome to lock and unlock.

It is an object of the present invention to overcome the shortcomings of these prior art devices and to provide a hasp which accommodates conventional padlocks of appropriate size and locks the hasp parts against forceful separation by prying, has great flexibility for mounting in numerous part configurations, does not inhibit padlock operation, and which occupies a relatively small mounting area and affords an attractive appearance.

Other objects are to provide a hasp which will hinder direct access to a padlock shackle with quick, silent tools such as a bolt cutter and has no movable protuberances which might result in risk of injury to users.

SUMMARY OF THE INVENTION

The apparatus of the present invention is characterized by first and second hasps incorporating mounting plates for mounting on parts to be locked together and including coextensive first and second hasp plates formed on their respective one ends with laterally extending open ended slots for receipt of the pivot leg of a padlock shackle and formed on their respective opposite ends with bores for receipt of the closure leg of such shackle. Mounted on one or the other, or both, of the hasp plates is a guard plate which projects longitudinally of the shackle to independently form a box like structure restricting access to the shackle. A spacer projects from the hasp to engage the padlock body near one end to maintain such one end tilted away from the adjacent hasp plate, with the opposite end tilted into close proximity with such plate to thus cooperate with the closed end of the shackle in trapping such hasp plates against separation from one another.

Other objects and features of the invention will become apparent from consideration of the following description taken in connection with the accompanying drawing.

DESCRIPTION OF THE PREFERRED EMBODIMENT

Figure 1:
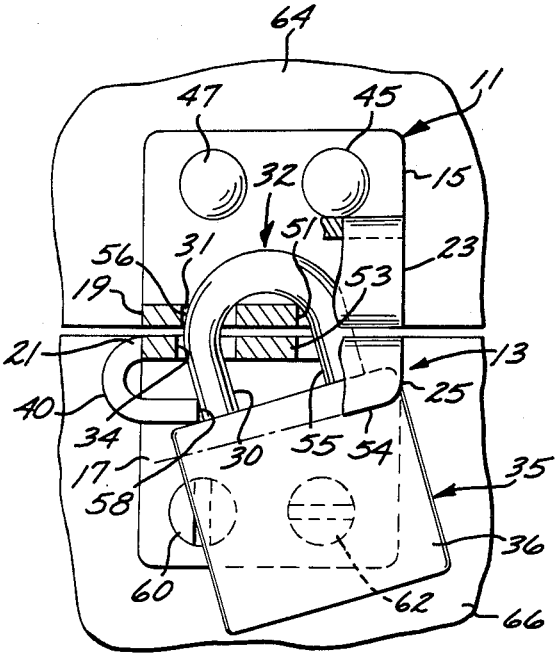
FIG. 1 is a front view, partially broken away, of a constraining tamper proof padlock hasp incorporating my invention.
Figure 2:
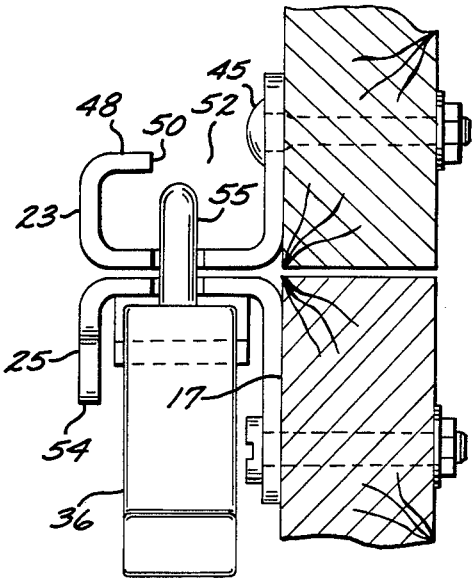
FIG. 2 is a right end view of the tamper proof padlock hasp shown in FIG. 1.

Referring to FIGS. 1 and 2, the preferred embodiment of the hasp apparatus of the present invention includes, generally, upper and lower hasps 11 and 13, respectively, each of generally U-shaped in cross section construction disposed in back to back relationship. One leg of each respective U-shaped hasp forms a respective planar vertical mounting flange 15 and 17, and the closed end of each, respective co-planar, horizontal hasp plates 19 and 21, and the opposite legs of each, respective vertical guard plates 23 and 25. The upper and lower hasp plates are formed at their respective one extremities with respective vertical bores 31 and 34 which receive the vertical shackle closure leg 33 of a padlock shackle 32. A spacer tongue 40 projects from such one end of the lower hasp plate 21, turns downwardly and back on itself to serve as a spacer to engage one end of the padlock body 36 and maintain it tilted to engage the opposite end with the underside of the plate 19 and cooperate in holding the hasp plates firmly constrained in close spaced relationship within the shackle 32 to positively prevent forced separation of the plates 19 and 21, as by prying.

Figure 3:
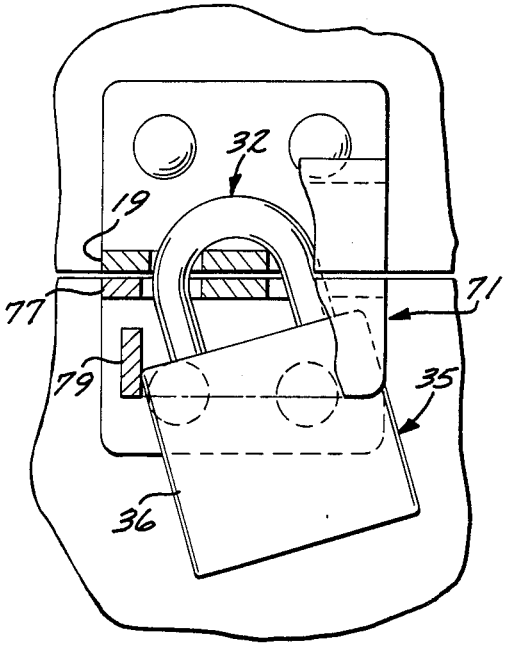
FIG. 3 is a front view, partially broken away, of a second embodiment of the tamper proof padlock hasp of the present invention.
Figure 4:
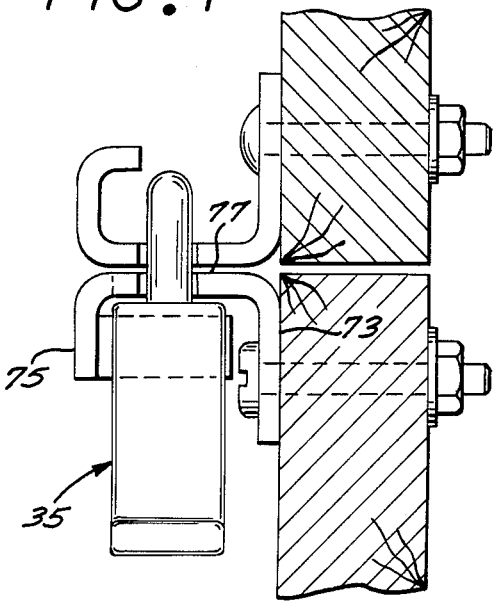
FIG. 4 is a left end view of the tamper proof padlock apparatus shown in FIG. 3.

The upper and lower hasps 11 and 13 may be constructed of high tensile metal and are shown in the preferred embodiment with a generally U-shaped cross sectional configuration. The mounting flanges 15 and 17 are generally rectangular and the top flange 17 conveniently formed with a pair of spaced square mounting openings for receipt of the shoulders of respective carriage bolts 45 and 47 (FIG. 3). The hasp plates 19 and 21 are formed at their respective one ends with respective open ended slots 51 and 53 for receipt thereinto of the pivot leg 55 of the padlock shackle 32 (FIG. 4). If desired, the upper leg receiving bore 31 may be of a sufficiently small diameter to engage the wall thereof with the curvature of the loop at the end of the shackle 32 to restrict downward travel of such shackle relative the hasp plate 19. As will be apparent to those in the art, the spacing between the bore 31 and closed end of the upper slot 51 in the upper hasp plate and may be set to engage the proximal side walls thereof with the inside shoulders of the shackle loop to, independently, limit downward travel of the shackle.

The guard plates 23 and 25 are generally rectangular, the upper plate 23 being turned inwardly (FIG. 2) at its upper extremity to form a horizontal blocking lip 48 which terminates in an edge 50 spaced from the mounting flange 15 a distance sufficient to provide a relatively narrow gap 52 allowing for free receipt therebetween of the shackle 32 but limiting access to such shackle when it is in its locked position resting on the upper hasp plate 19. The relatively narrow gap 50 also serves to inhibit installation of the padlock in its inverted position or orbiting of the properly locked padlock from its upright to its inverted position.

It will be appreciated that padlocks 35 are formed in many different sizes and shapes. However, the majority of presently available padlocks fall into, for instance, two or three size categories, each category of which is characterized by padlocks incorporating shackles 32 which are of somewhat uniform standard diameter and have relatively uniform radii for the closed end thereof. Accordingly, it will be appreciated that the spacing between the proximal sides of the hasp plate 19 and 21 may be relatively standard for particular sizes of padlocks. The spacing between such hasp plates 19 and 21 may conveniently be set at the time of installation by inserting a standard thickness gauge between such plates to positively attain the desired setting.

The lower hasp 13 is formed with the vertical guard plate 25 spaced a distance from the vertical mounting plate 17 slightly greater than the width of a standard padlock body as shown in FIG. 2 to thus limit any capability of the padlock to be twisted within the confines thereof and to, more importantly, cooperate in limiting access to the shackle 32. The lower guard plate 25 terminates in a bottom edge 54 which angles downwardly and to the left as viewed in FIG. 1, the lefthand portion thereof being shown in phantom line. Such lower edge slopes at the same angle as the top surface of the padlock body 36 when such padlock is in its locked position as dictated by the spacer tongue 40. It will be appreciated that the guard plate 25 overlaps and projects downwardly beyond the plane of the top surface of such padlock body 36 to thus cooperate in restricting access to the shackle 32.

Referring to FIG. 1, the lower hasp plate 21 is formed with the tongue 40 projecting from the left end thereof and then turning down and back on itself in a U-shaped configuration to terminate in an edge 58, which abuts the confronting surface of the capture leg 30 and the top surface of the padlock body 36 to thus maintain the padlock in its tilted position shown in FIG. 1. The degree of such tilt is sufficient to maintain the top of the right end of such padlock body disposed in juxtaposition with the underside of the bottom hasp plate 21 to thus block upward travel of the padlock body 36 to thus constrain the shackle 32 against upward travel relative to the hasps 11 and 13.

Referring to FIG. 2, the lower mounting flange 17 is formed with a pair of spaced apart bores for receipt of respective mounting bolts 60 and 62, the heads of which are formed with screw slots for ease of installation. It will be appreciated that such heads, when the padlock 35 is in its locked position, are disposed behind such padlock body 36 to block access thereto.

From the foregoing, it will be apparent that the tamper resistant shackle apparatus of the present invention may be installed with the hasp 11 being received, for instance, on the edge of a horizontally disposed sliding hatch cover 64 and the bottom hasp 13 mounted on a vertically disposed hatch board 66 to prevent relative movement therebetween. The distance between the proximal surfaces of the hasp plates 19 and 21 may be established by inserting a spacer gauge therebetween during installation. With the hasps 11 and 13 installed in the positions shown in FIGS. 1 and 2, a standard padlock 35 may covneniently be installed in the manner shown to maintain the shackle thereof protected from ready access.

The padlock 35 may be installed by unlocking such padlock and rotating the body 36 around the pivot leg 55 to a position extending 180 degrees from the position shown in FIG. 1. The shackle 32 may then conveniently and easily be installed by sliding the pivot leg 55 laterally into the open ends of the slots 51 and 53 bringing the capture leg 30 into alignment over the bores 31 and 34. The shackle 32 may then be lowered to insert the leg 34 to engage the inside of the loop forming the end of such shackle with the proximal walls of the bore 31 and slot 51 as shown in FIG. 1 thus limiting further downward travel of such shackle.

It will be appreciated that axial travel of commercially available padlocks on their pivot legs 55 is such that, with the padlock fully lowered thereon, the top surface of the body 36 will clear the bottom edge 54 of the guard plate 25 such that the body may be rotated 180 degrees on such pivot leg to the rotational position shown in FIG. 1. The body can then be slid axially upwardly on the pivot leg 55 to the position shown in FIG. 1 causing such shackle to be locked within the confines of the body 36 to thereby maintain the left end top surface thereof abutted against the underside of the tip of the spacer tongue 40 and the right hand end thereof abutted with the underside of the bottom plate 21. This construction then serves to closely confine and entrap the upper hasp plate 19 within the closed loop end of the shackle 32 to thus positively restrict upward movement of such plate relative to the lower plate 21 thereby restricting entry of the working end of a screwdriver or other pry tool within the gap between such plates thus minimizing the threat of sufficient purchase being achieved between such plates to enable a would be intruder from prying such plates apart.

With the path of vertical travel of the shackle 32 being limited in this manner, in conjunction with rotational travel thereof being likewise limited, unauthorized personnel are also foiled in their efforts to manipulate the padlock relative to the hasp to such a degree as to expose the shackle 32 at any location to an extent where reasonable access could be had thereto by such readily available tools as bolt cutters, hacksaws and the like. Moreover, it will be appreciated that access to the space between the top surface of the padlock body and underside of the lower hasp plate 21 is so restricted that reasonable access cannot be had thereto by screwdrivers or other pry tools which might otherwise be employed in effort to pry the body of the padlock away from the shackle in effort to break the locking mechanism.

The tamper resistant padlock apparatus shown in FIGS. 3 and 4 is similar to that shown in FIG. 2 except it includes a lower hasp 71 which is also generally U-shaped in cross-section and is formed with a vertical mounting flange 73 having a guard plate 75 spaced therefrom and extending parallel thereto, such flange and plate being connected together by means of a horizontal plate 77. Mounted at one end of the guard plate 75 is an inturned, laterally projecting spacer tab 79 arranged and disposed for abutment thereagainst of the upper lefthand corner of the body 36 of the padlock 35 (FIG. 3). Thus, the tab 79 serves to maintain the padlock 35 in its generally tilted position with the upper right corner of the body in close proximity or in contact with the underside of the hasp plate 77 to thereby cooperate with the shackle 32 in constraining the plates 19 and 77 against separation.

From the foregoing, it will be appreciated that the tamper resistant hasp apparatus of the present invention provides a sturdy protective device which is economical to manufacture and is adapted to receive conventional padlocks and to protect the shackle thereof from direct access by conventional tools and further to hold the hasp plates captive to resist separation thereof for access by pry tools and the like.

I claim:

1. Padlock hasp apparatus for receiving a padlock to lock first and second parts together and including a padlock body formed with a top surface and mounting an inverted U-shaped padlock shackle of a predetermined cross sectional diameter and formed on its closed end with a loop of a selected inside radius leading to respective oppositely disposed, generally straight, pivot and capture legs which cooperate to, when such shackle is in its locked position, from a predetermined configuration, said apparatus comprising:

first and second hasps for mounting on the respective first and second parts and formed with respective first and second mounting flanges and first and second hasp plates arranged to, when mounted on such parts, project coextensive to one another, said first and second hasp plates being formed with aligned first and second capture leg-receiving bores, respectively, each bore being larger than such predetermined cross sectional diameter, said first and second hasp plates being further formed with respective first and second pivot leg-receiving slots for receiving such pivot leg when said capture leg is received in said capture leg-receiving bores such that said mounting flanges of said first and second hasps may be mounted on said respective first and second parts with the opposed surfaces of said plates spaced a specified distance apart for receipt of such padlock capture leg and pivot legs in such bores and slots, respectively, to engage the inside of such loop on the top surface of such first hasp plate;

one of said hasps including a spacer disposed adjacent said capture leg receiving bore and formed with an abutment surface spaced in one direction from said second hasp plate for engaging the body of said padlock to, when said pivot and capture legs are received in said respective bores and slots and said shackle is in its locked position, engage one side of said padlock body to maintain said body tilted sufficiently relative to said hasp plate, and spaced a sufficient distance from said first hasp plate to substantially block travel of said body in a direction toward said first hasp plate to thereby substantially prevent movement of said first hasp plate away from said second hasp plate; and guard plate means mounted on said first or second hasps and projecting in a direction opposite said one direction, at least, to the extended plane of such top surface of such padlock body, when said shackle is in such locked position.

2. Padlock hasp apparatus as set forth in claim 1 wherein:

said second hasp plate is planar and said second hasp is formed with a U-shaped tounge projecting from the end adjacent said second capture leg receiving bore, said tongue turning back on itself to define said spacer.

3. Padlock hasp apparatus as set forth in claim 1 wherein:

said second hasp plate is planar and said spacer projects laterally therefrom to engage such top surface of such padlock body and to block access from one end of said body to the space between said top surface and said second hasp plate.

4. Padlock hasp apparatus as set forth in claim 1 wherein:

said spacer is of substantially the same width as such padlock body.

5. Padlock hasp apparatus as set forth in claim 1 wherein:

said guard plate means includes a second guard plate projecting in said one direction a distance sufficient to, when such padlock is in such locked position, project, at least, to the extended plane of such top surface.

6. Padlock hasp apparatus as set forth in claim 1 wherein:

said guard plate means includes a lip formed at such extremity of such guard plate and projecting parallel of such first hasp plate to, when such padlock is in such locked position, cooperate in blocking access to such shackle.

7. Padlock hasp apparatus as set forth in claim 1 wherein:

said guard plate means includes a first guard plate mounted on said first hasp plate and projecting in such direction opposite said one direction and a second guard plate mounted on said second hasp plate and projecting in said one direction.

8. Padlock hasp apparatus as set forth in claim 1 wherein:

said first and second hasp plates project perpendicular to the respective first and second mounting flanges.

9. Padlock hasp apparatus as set forth in claim 1 for use with a padlock having a body of a predetermined width wherein:

said mounting flanges and guard plates of the respective hasps project perpendicular to one another and said guard plate means includes a lip mounted at said extremity of such guard plate means, said lip projecting toward said first mounting flange to terminate in an edge spaced from said first mounting plate.

10. Padlock hasp apparatus as set forth in claim 1 wherein:

said first and second hasp plates are formed with said first and second pivot leg-receiving slots open to the side of the respective plates opposite the respective bores.

11. Padlock hasp apparatus as set forth in claim 1 wherein:

said first hasp is generally U-shaped in cross section to form said first mounting flange and first guard plate.

12. Padlock hasp apparatus as set forth in claim 1 wherein:

said second hasp is generally U-shaped to form said second mounting flange and guard plate projecting perpendicular to one another.

13. Padlock hasp apparatus for receiving a padlock having a shackle carried from a body for locking first and second parts together and including:

first and second hasps formed with respective first and second mounting flanges and respective first and second hasp plates arranged such that said first and second hasps may be mounted in positions on said first and second parts with said hasp plates extending coextensive with one another, said first and second hasp plates being formed on their respective one ends with respective first and second aligned bores for receiving the closure leg of such shackle and formed at their respective opposite ends with slot means for receiving the pivot leg of such shackle so such shackle may, with such legs so received, be locked in a locked position restricting relative movement of such hasps;

spacer means mounted on said second hasp and formed with an abutment surface spaced from said second hasp plate a distance sufficient to, when such padlock is in such locked position, engage such body and limit longitudinal travel of such legs relative to said hasps to define the path of travel for such shackle; and guard plate means mounted on one of said first or first and second hasp plates and projecting longitudinally thereof a distance coextensive with said path of travel of such shackle when in its locked position whereby such guard plate means will block access to such shackle.

* * * * *